United States Patent [19]

Strait

[11] 4,354,416

[45] Oct. 19, 1982

[54] VIOLIN BRIDGE FOR A STRINGED INSTRUMENT

[76] Inventor: Carl Strait, R.R. #3, Box 85, Andover, N.J. 07821

[21] Appl. No.: 312,381

[22] Filed: Oct. 19, 1981

[51] Int. Cl.[3] ..... G10D 3/04

[52] U.S. Cl. ..... 84/309; D17/21

[58] Field of Search ..... D17/17, 21; 84/274–283, 307, 309–311

[56] References Cited

U.S. PATENT DOCUMENTS

| | | | |
|---|---|---|---|
| 129,653 | 7/1872 | Collins | 84/279 |
| 191,029 | 5/1877 | Collins | 84/274 |
| 693,648 | 2/1902 | Hurley | 84/309 |
| 1,173,017 | 2/1916 | Morris | 84/275 |
| 1,356,439 | 10/1920 | Fitt | 84/309 |
| 3,186,288 | 6/1965 | Finch | 84/275 |

FOREIGN PATENT DOCUMENTS

| | | | |
|---|---|---|---|
| 338458 | 6/1921 | Fed. Rep. of Germany | 84/309 |

*Primary Examiner*—Lawrence R. Franklin
*Attorney, Agent, or Firm*—H. Hume Mathews

[57] ABSTRACT

A bridge for a stringed instrument, preferably a violin, for enhancing the volume and tonal quality of the instrument. The bridge is constructed of wood and has a broad fan-shaped face and a pair of depending lower legs having a U-shaped indentation between them. The face has a pattern of a plurality of holes drilled therethrough to improve the sensitivity of the bridge, thereby improving its quality. An alternate embodiment includes slots cut through the drilled holes.

4 Claims, 4 Drawing Figures

VIOLIN BRIDGE FOR A STRINGED INSTRUMENT

BACKGROUND OF THE INVENTION

This invention relates to a bridge for stringed instruments, more particularly for violins.

The important function of a violin bridge has been long recognized. In addition to holding or supporting the strings of the instrument, the bridge functions to transmit sound vibrations from the string to the body of the instrument. The transmission and resonant qualities of the bridge determine the tonal quality and volume of the instrument. In order to produce the fullest sound the vibration must be able to pass from the strings to the body with minimum obstruction.

Heretofore, several difficulties have been encountered in attempting to develop an ideal bridge. Normally trial and error was employed in determining the tonal effect of each bridge. Many bridges are known in the prior art which attempt to present high quality sound. These include my prior U.S. Pat. No. 4,023,459, issued May 17, 1977; but none of these achieve the quality that is achieved by the bridge of the present invention.

SUMMARY OF THE INVENTION

Accordingly, the present invention discloses a bridge for supporting the strings of a stringed instrument, more particularly a violin.

The bridge has a generally fan-shaped upper body portion, and is supported on a pair of legs having an inverted, U-shaped indentation between them. The upper surface of the bridge has a smooth, curved surface, except for the string-receiving grooves, symmetrically spaced thereon.

In a preferred embodiment, a series of holes are provided in the upper body portion of the bridge which enhance the quality and volume of the sound transmission from the strings to the body of the instrument.

The size, location and arrangement of the holes determine the degree of sensitivity of the bridge, thereby the quality of sound transmitted.

An alternate embodiment of the bridge has holes which include slots or cuts extending from the holes. These slots increase the sensitivity of the bridge.

DETAILED DESCRIPTION OF THE PREFERRED EMBODIMENTS

As described in my previous U.S. Pat. No. 4,023,459, issued May 17, 1977, the bridge of the present invention should be made by hand and custom fitted to the particular instrument. Since each bridge is individually formed, no two will be exactly alike. Therefore, the description that follows is only a representation of the structural form of a bridge, rather than an accurate or precise dimensional description. The dimensions given are only supplied by way of example and are not intended to limit the scope of the invention.

Also, as noted in my above-mentioned U.S. Patent, the present invention may be adapted to any stringed instrument played with a bow. In order to more clearly describe the invention it will be assumed that the bridge is used with a violin, with the G-string notch appearing on the right and the E-string notch appearing on the left as shown in FIG. 1.

Figure 1:
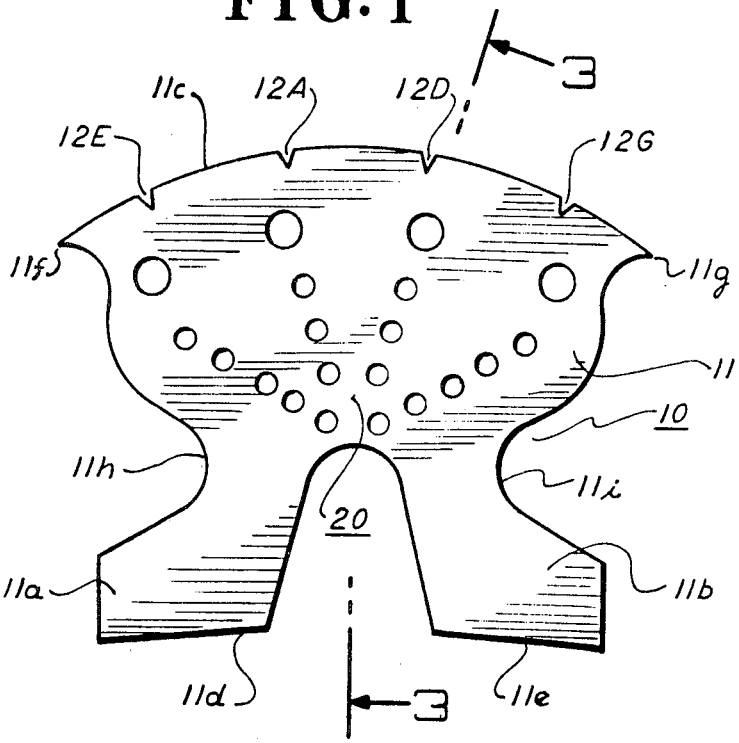
FIG. 1 is a front elevation of the preferred embodiment of the stringed instrument bridge.

Referring in detail to FIG. 1, the bridge 10 shown in front elevation, is best made from a single piece of wood having uniform gain and texture. The bridge 10 should be carved by hand from naturally dried wood cut on the quarter, as is well known in the prior art. The initial piece of wood should be about 2 square inches and ¼ inch thick.

The bridge 10 has a body portion 11 and legs 11*a* and 11*b*. Body portion 11 is roughly fan-shaped, having a broad front and rear face. The upper surface 11*c* is smooth, except for the symmetrically spaced receiving grooves 12E, 12A, 12D & 12G. Each of these grooves, are say ½ the diameter of the string and are roughly 7/16 inches apart.

Legs 11*a* and 11*b* extend down from body portion 11 and have a U-shaped indentation between them. When the bridge is installed on the violin, the legs 11*a* and 11*b* are individually cut or shaved so that if conforms to the particular violin.

Other distinguishing characteristics of the bridge of the present invention include the winged lateral edges 11*f* and 11*g* of upper surface 11*c*. Also, lateral indentation 11*h* and 11*i* constrict the upper portion of legs 11*a* and 11*b*.

The finished bridge, when adapted for use with a violin, should be about 1 11/16 inch high, but will vary according to the exact needs of each violin. The width of the bridge is about 1 13/16 inch, but as previously mentioned, the exact dimensions are dictated to conform to the specific violin. The total width of the body 10 should be selected to produce the most superior sound. Preferably, the overall weight of the bridge is near the total weight of the portion of the four strings which are strung on the violin, or about 2.6 g. The shape of the face together with the inverted U-shaped indentation between the legs, presents the most favorable support for the strings which produces maximum vibration characteristics.

Further details for the construction of a suitable bridge and its optimum dimensions are disclosed in my above-mentioned prior U.S. Patent, and that description is herein incorporated by reference.

In the present invention body 10 of the bridge 1 is provided with a patterned series of holes 20. The latter is arranged in roughly four linear sets of five holes each emanating from the lower central portion of body 10 and terminating below each of the grooves 12E, 12A, 12D and 12G accomodating the E, A or G strings, respectively.

The holes 20 are all of uniform diameter, for example 7/64 inch, except for the last holes of each set, adjacent each of the strings, which are about 9/64 inch in diameter. These larger holes have been found to free-up the stoic attitudes of the instrument as is well known in the art. The degree of sensitivity of the bridge is determined by the size of the holes bored through. The greater the size of the holes (i.e. the less wood between the violin and the strings) the greater the sensitivity of the bridge.

It is apparent that the more weight that is removed from the bridge between the strings and the violin the greater degree of sound and tonal quality will be attained.

Figure 2:
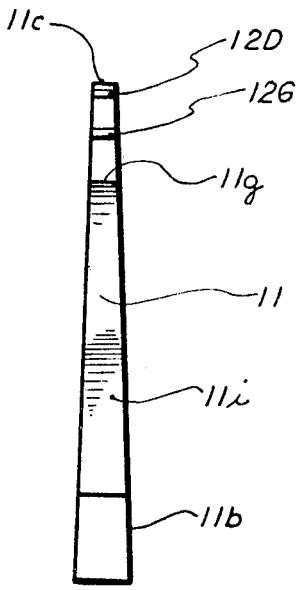
FIG. 2 is a side elevation of the bridge of FIG. 1.
Figure 3:
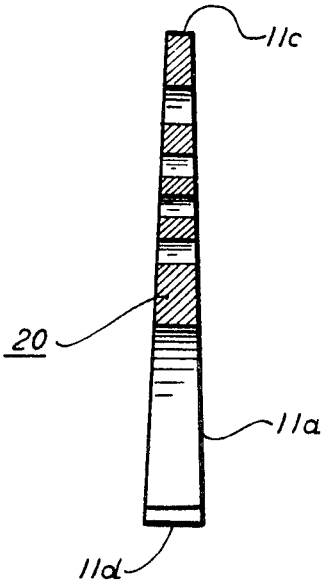
FIG. 3 is a cross-section taken along the lines 3—3 of FIG. 1.

FIGS. 2 & 3 show a side elevation and vertical cross-section respectively of the bridge of the present invention. The thickness of the bridge may vary to meet the particular needs of each instrument, but generally the thickness ranges between 3/16 and 1/16 inch at various points along the bridge. The bridge is thickest at its lower end (the base of legs 11*a* and 11*b*) and tapers slightly to the highest point (at the upper curved surface 11*c*). It is noted that a precise dimension or description of the same shape and thickness can not be given as the bridge is made by hand and each bridge will vary slightly from the rest according to human variations.

Figure 4:
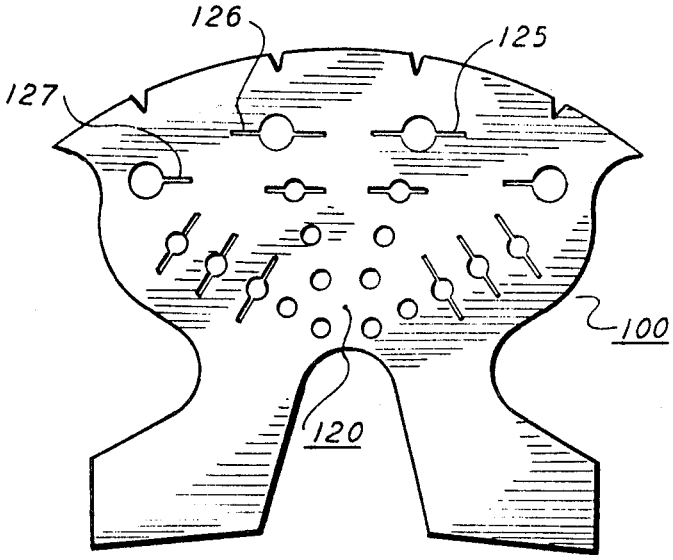
FIG. 4 is a front elevation of an alternate embodiment of the bridge of the present invention.

An alternate embodiment of the bridge is shown in FIG. 4.

The modification of the bridge 100 of FIG. 4 over that of bridge 10 of FIGS. 1–3 is that some or all of the holes 20 include diametrical slots 125 therethrough.

These slots serve to remove further weight from the bridge to further increase its sensitivity. Slots 125 may fully cross each of the holes 120 (as shown by slots 126), or may extend from only one side of the holes (as shown by slot 127). The slots provide for a more pure sound, particularly for the "highs" and "lows".

The location, size and number of slots can be made to suit the desired need.

What is claimed is:

1. A bridge for use with a stringed instrument comprising:

(a) a generally fan-shaped upper body portion supported by a pair of legs having an inverted U-shaped indentation therebetween, said upper body portion having a smooth, curved upper surface with string receiving grooves symmetrically spaced thereon;

(b) a series of holes in said upper body portion extending from each string receiving groove generally downwardly to the top of said inverted U-shaped indentation; and (c) the holes in each of said series being of substantially uniform diameter excepting the holes nearest to the string receiving grooves, which are substantially larger in diameter than the other holes.

2. A bridge according to claim 1, in which at least some of the holes are diametrically intersected by slots.

3. A bridge according to claim 1, in which said legs are solid and free of holes so that the bridge may be fitted to a particular stringed instrument by cutting the legs without adversely affecting the tonal performance of the bridge.

4. A bridge according to claim 1, in which said upper body portion is provided with a winged lateral edge protruding outwardly from each side of said curved upper surface.

* * * * *